US009550945B1

(12) United States Patent
Ball, IV et al.

(10) Patent No.: US 9,550,945 B1
(45) Date of Patent: Jan. 24, 2017

(54) LOCAL PRODUCED OIL DEHYDRATOR

(71) Applicants: Breakthrough Engenuity, LLC, Bixby, OK (US); Gary L. Johnson, Tulsa, OK (US)

(72) Inventors: Will D. Ball, IV, Bixby, OK (US); Gary L. Johnson, Tulsa, OK (US)

(73) Assignees: Gary L. Johnson, Tulsa, OK (US); Breakthrough Engenuity, LLC, Bixby, OK (US)

( * ) Notice: Subject to any disclaimer, the term of this patent is extended or adjusted under 35 U.S.C. 154(b) by 0 days.

(21) Appl. No.: 14/841,756

(22) Filed: Sep. 1, 2015

(51) Int. Cl.

| | |
|---|---|
| ***C10G 7/04*** | (2006.01) |
| ***C10G 33/00*** | (2006.01) |
| ***C10G 33/04*** | (2006.01) |
| ***C10G 33/08*** | (2006.01) |

(52) U.S. Cl.
CPC ..... *C10G 33/04* (2013.01); *C10G 7/04* (2013.01); *C10G 33/08* (2013.01)

(58) Field of Classification Search
CPC ..... C10G 7/04; C10G 33/00; C10G 33/04
See application file for complete search history.

(56) References Cited

U.S. PATENT DOCUMENTS

| | | | | | |
|---|---|---|---|---|---|
| 1,592,324 | A * | 7/1926 | Allinson | C10G 33/06 | 196/106 |
| 1,611,370 | A * | 12/1926 | Primrose | C10G 33/06 | 196/107 |
| 1,704,588 | A * | 3/1929 | Black | C10G 33/04 | 196/134 |
| 1,833,619 | A * | 11/1931 | Pew | C10G 33/06 | 208/187 |
| 2,133,186 | A * | 10/1938 | Campbell | B01D 17/045 | 516/138 |
| 3,250,685 | A | 5/1966 | Graham | | |
| 3,394,530 | A | 7/1968 | O'Neill | | |
| 3,796,318 | A | 3/1974 | Underwood | | |
| 4,396,404 | A | 8/1983 | Engelman et al. | | |
| 4,995,495 | A | 2/1991 | Krynski | | |
| 5,499,531 | A | 3/1996 | Henderson | | |
| 6,372,123 | B1 | 4/2002 | Kresnyak et al. | | |
| 6,536,523 | B1 * | 3/2003 | Kresnyak | B01D 1/0047 | 166/266 |
| 6,849,175 | B2 | 2/2005 | Kresnyak | | |
| 7,097,761 | B2 | 8/2006 | Kresnyak | | |
| 7,531,099 | B1 | 5/2009 | Rhodes | | |
| 8,465,572 | B1 | 6/2013 | Ball, IV et al. | | |

* cited by examiner

*Primary Examiner* — Randy Boyer
(74) *Attorney, Agent, or Firm* — Millikin Intellectual Property Law, PLLC; Margaret Millikin

(57) ABSTRACT

A portable, semi-portable, or permanent system for removing BS&W from crude oil at the local production or bulk storage site. A demulsifier is added to the crude as it enters a low shear pump which pumps the mixture through a plate and frame type heat exchanger where the incoming crude is preheated using outgoing heated and dehydrated crude. Then the incoming crude enters an oil-water separator where it is further heated by a secondary heater within the separator and passes through a special coalescing section. Water and basic sediment separate from the crude are discharged from the bottom of the separator. The heated dehydrated crude exits the separator, flows back through the heat exchanger where it is cooled as it preheats incoming crude, and then is pumped to clean oil storage. BS&W and flow monitors on the incoming crude and outgoing crude are used to control operation of the system.

12 Claims, 1 Drawing Sheet

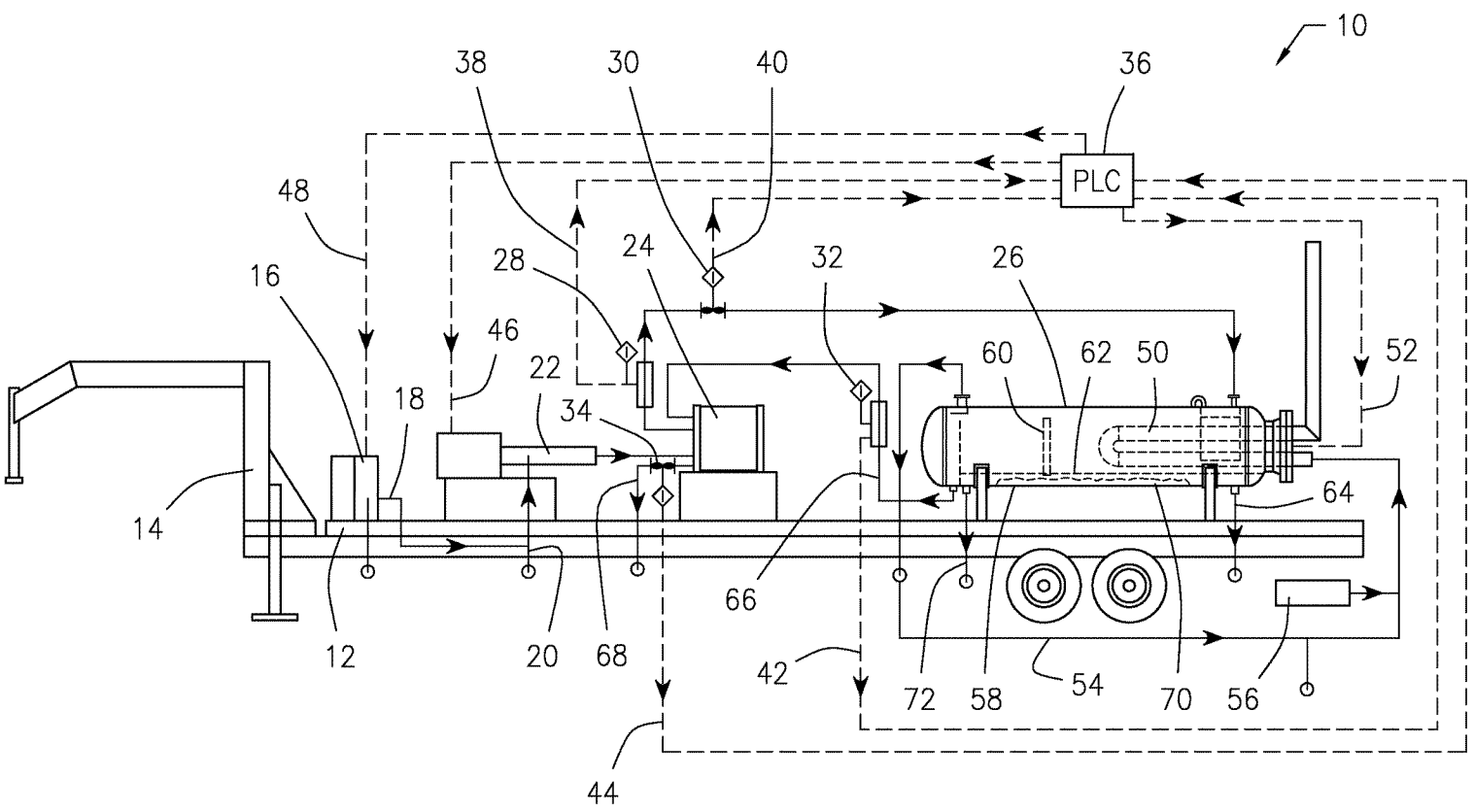
10
36
PLC
52
64
56
70
50
62
26
60
54
58
72
32
42
66
40
30
24
68
44
34
22
20
28
46
38
18
12
48
16
14

LOCAL PRODUCED OIL DEHYDRATOR

CROSS-REFERENCE TO RELATED APPLICATIONS

The present application is a divisional of U.S. patent application Ser. No. 14/196,210 filed on Mar. 4, 2014 for Local Produced Oil Dehydrator.

BACKGROUND OF THE INVENTION

1. Field of the Invention

The present invention is a trailer or permanently mounted oil dehydrator system for locally produced crude oil. The trailer mounted system can be transported to an oil well site or pipeline stations for use. The permanent system is permanently installed at the appropriate location. The system is designed to remove basic sediment and water (BS&W) from the crude oil prior to the oil being transported from the well site or prior to the oil being introduced into transportation pipelines feeding domestic refineries.

2. Description of the Related Art

Produced crude oil is considered "crude" in that it has not yet been refined. It exists at several hundred thousand individual well sites in the US. This crude oil is often crudely treated at the individual well site in an effort to remove entrained water; however, this effort often falls short. In order to ultimately move all produced crude oil to market, the pipeline crude oil gathering sector accepts this often off-spec crude oil and historically has used only the dilution (blending) process to mask the high concentration of water in a portion of the overall stream prior to shipping the entire blended stream on to the next gathering point via truck transport or pipelines and ultimately into U.S. oil refineries.

Prior to the present invention, pipeline stations used a blending technique to mix crude oil with little or no entrained water with crude oil with up to 10% basic sediment and water (BS&W) to render the mix below 0.5% total BS&W, the typical maximum acceptable by U.S. refiners. Obviously, this blending process required very large quantities of water free crude, so water laden crude oil had to be stored for extended periods in very large tank farms until it could be effectively diluted.

In fact, while the dilution process technically meets the BS&W criteria, it does not remove the water from the crude at all. The refiners must therefore separate the entrained water from their incoming crude oil streams; however diluted the water may be in the crude oil streams. This entrained water represents a serious cost and hazard to refiners, so removing it from the crude oil prior to the oil entering the transportation chain leading to refineries, i.e. crude oil pipelines, is a very significant benefit to the refineries.

Additionally, removing the BS&W at the pipeline stations is a benefit to the pipelines and downstream storage facilities in that the overall volume of transferred crude oil is reduced, thus increasing the net capacity of the pipelines and downstream storage facilities. Those downstream storage facilities include both those along the way to the refineries, such as crude oil storage hubs along the pipeline routes, and those at the refineries where the crude oil is stored in massive tank farms prior to being refined.

Heretofore it there has not been any obvious, economic, or reasonable solution for removing BS&W from the crude oil before it is transported.

Although crude oil dehydration is often attempted to some degree at the points of origin, i.e. at the individual oil well site, that effort is often inefficient. Those attempts at dehydrating the crude oil at the individual oil well site have never embodied the components selected for use in the present invention.

First, low shear pumps are not currently used at well sites. In fact the opposite is true of typical oilfield crude transfer systems. Currently employed typical oilfield crude transfer systems employ high shear pumps. The water droplet shearing characteristics of these high shear pumps agitate and cause increase water-in-oil mixing. Those water droplet shearing characteristics conflict with Stokes' Law separation and ultimately leave larger quantities of water in the crude oil streams.

Second, while some crude is heated at the point of origin to offset the aggravated conditions created by these droplet shearing devices upstream, no effort is made to capture or use any of that heat at the local level, so considerable fuel and related heating energy is wasted. These streams are often shipped to pipeline stations with excessive water concentrations, causing the traditional blending process to be a necessary part of this sector of industry, and creating the need for the present invention.

Finally, the water that is contained in the crude is generally corrosive to metal and any water concentration in the crude presents a significant corrosion potential in both the pipeline equipment and the refinery equipment.

The present invention addresses all of these issues by providing a uniquely efficient crude oil dehydration system designed for local application on oil well sites and pipeline stations where the efficient dehydration of crude oil has its maximum economic benefit to industry by preconditioning the crude prior to transportation to refineries.

The invention combines three benefits: 1) a low shear transfer pump to take fullest advantage of Stokes' Law separation condition, 2) a small, highly efficient heat transfer system to transfer heat from the treated crude oil to the incoming untreated crude oil to preheat the incoming crude oil while cooling the outgoing treated crude oil, and 3) an oil-water separation system designed to preheat the inlet fluid initially, and once pre-heated, to separate small quantities of water from large quantities of crude oil.

SUMMARY OF THE INVENTION

The invention is a system for removing BS&W from crude oil at the local production site or before the crude oil is transported to a refinery via trucks or pipelines. The system is portable, semi-portable, or permanently installed, and can be trailer or skid mounted so that it can be easily relocated if and when portability is a useful benefit. All system components are preferably skid mounted and pre-piped to augment portability. Piping is extended to skid edge where hammer union connections allow for easy and rapid hook-up. The skid can be mounted on a trailer for ultimate portability, or set on a suitable foundation for semi-permanent or permanent services.

The system employs a chemical additive that is introduced into the raw crude oil stream as the crude oil is pumped into the system by a low shear pump. The chemical additive will be selected specifically for the site specific needs, but generally will be an emulsion breaking chemical or demulsifier. The pump mixes the chemical additive sufficiently with the crude without causing the mixture to emulsify.

The pump used in this application is specially selected. Most pumps tend to aggravate the BS&W content of crude oil, acting as blenders. Therefore, to offset this deficiency, the present invention employs a non-blending, non-shearing pump known as a progressing cavity pump. This type of pump is characterized as being similar in design to an auger. This pump design eliminates the detrimental shearing forces by replacing sharp edges with smooth surfaces, and uses only low speeds, eliminating the blending effect of typical pumps. This pump is fitted with a special motor and motor controller to be able to vary the pump speed and thus the fluid flow through the system.

The pump sends the mixture through a plate and frame type heat exchanger where the incoming crude oil mixture is preheated using the already heated and dehydrated outgoing stream of crude oil. A plate and frame heat exchanger is employed because of its very large heat transfer fluid contact surface area and its small, light-weight footprint, making it ideal for portability.

This preheating that occurs in the heat exchanger lowers the viscosity (thickness) of the incoming crude oil mixture so the heavier water droplets can more readily separate as they enter the oil-water separation portion of the system. Upon leaving the heat exchanger, the preheated crude oil mixture flows through an incoming electronic BS&W monitor that continuously measures the varying levels of BS&W concentration entering with the incoming crude oil and flows through an incoming electronic flow meter that continuously measures the quantity of crude oil and its entrained BS&W entering the system and flowing to an oil-water separator within the system. These instruments automatically control the flow of the emulsified crude oil through the system, and the injection rate of the emulsion breaking chemical.

The effluent of treated, dehydrated crude coming out of the separator also flows through an outgoing electronic BS&W monitor and an outgoing electronic flow meter that continuously measure, respectively, the concentration of BS&W exiting the system in the treated crude oil and the quantity of treated crude oil flowing out of the system, adjusting the flow and chemical additive rates to maximize the elimination of the BS&W.

The signals coming from the incoming electronic BS&W monitor and the incoming electronic flow meter are compared with a measurement of the BS&W concentration in the treated crude effluent by a project logic controller (PLC). The comparison of these inputs is used by the PLC to vary the pump speed and thus the flow rate through the system, to vary the chemical additive concentration added to the incoming crude oil, and to vary the degree of heat being applied by the secondary heating system within the separation vessel. This level of automation automatically optimizes the performance of the system, regardless of the quantity of BS&W contained within of the incoming crude oil.

Once the crude is pre-heated in the heat exchanger, the bulk of the entrained water readily separates, leaving only minor amounts of the smallest droplets of water in the in the crude oil stream. The demulsifier that is added to the incoming crude upstream of the oil-water separator is a chemical that assists in droplet growth which helps to augment the separation of these water droplets from the crude oil. The additive causes the smallest water droplets to coalesce into much larger droplets which are much more prone to separate according to Stokes' Law of separation.

Upon entering the oil-water separator vessel, additional heat may be added to the mixture to further reduce the crude oil viscosity and to further augment oil-water separation in the separator vessel. Heat is added by a large surface area secondary heater similar to a household gas water heater. In the secondary heater an industrial burner is fitted with the flame safety components assuring safe and efficient heat generation. The safety burner efficiently mixes gaseous fuel with air creating a quiet flame which "licks" the inner walls of a steel pipe known as the "firetube" (again, like the center tube in a natural gas household water heater). Gaseous fuel is supplied by gas separated in the separator vessel and is supplemented, as needed by an additional gaseous fuel source. The tube heats the oil and emulsion, reducing its viscosity an promoting more complete separation.

Inside the separator, freely separable water separates below the firetube and exits the separator only slightly heated, thereby conserving fuel. The crude oil, with its inherent BS&W, rises across the firetube. As the mixture is heated its viscosity is reduced dramatically until the crude oil and emulsion are as thin as the water itself. Heating crude not only lowers its viscosity, it decreases its effective density, making it even lighter compared to the water droplets in it which then can fall though it more rapidly. The heavier water then falls through the lighter oil and is separated from the oil at the bottom of the separator.

Since water droplets nucleate around tiny particles of naturally occurring solids, the water droplets carry with them the solids component defined as "basic sediment" as they fall out of the oil. However, heat alone will not resolve the entirety of the BS&W component. The smallest droplets tend to stay suspended in the oil. While heavier than oil, the flowing velocity of the crude may exceed the falling velocity of the tiniest water droplets, keeping them suspended in the oil.

In order to remove these tiniest water droplets, the present system employs a combination of chemical additives and a flow path that takes the crude oil and water droplets through a special coalescing section inside the oil-water separation vessel or separator, such as the one taught in U.S. Pat. No. 8,465,572 that issued on Jun. 18, 2013. The teaching found in U.S. Pat. No. 8,465,572 is incorporated herein by reference. The special coalescing section is a series of stainless steel parallel, inclined thin corrugated plate surfaces that are oriented so falling droplets impinge on them in a flow path that is less than one vertical inch. The chemical additive brings the smallest droplets together, increasing their droplet size, promoting more rapid Stokes' Law separation, while the coalescing section accumulates the tiniest of the water droplets as the crude and BS&W traverse their torturous pathways through this coalescing section inside the separator. Water droplets impinge and collect on the surface of the plates where they are therefore separated, and they migrate downward on the plate surfaces because of their higher density until they reach the water layer where they disengage from the plates and become a part of the water layer located beneath the oil within the separation vessel. This accelerates separation and promotes final dehydration of the smallest water droplets, resulting in a 99.99% dehydrated crude oil stream ready to be sent to any refinery.

The water then leaves the vessel as separated water. Heated and dehydrated oil then flows out of the separator and back through the heat exchanger, preheating the incoming crude and cooling the dehydrated crude in the process. The dehydrated crude then is sent to clean oil storage. From there it is finally shipped to the refinery via trucks or pipeline.

Since the term "BS&W" includes a caveat that the crude oil may have some sediment or solids, the separator is designed so these heavy solids will accumulate on the bottom of the separator. Any solids separating in the separator will be drained from the separator using a solid-dedicated "V" shaped solids removal systems designed specifically for this purpose to avoid the necessity of having to physically enter the separator to clean out the sediment.

BRIEF DESCRIPTION OF THE DRAWINGS

FIG. 1 is a diagram of a local produced oil dehydrator constructed in accordance with a preferred embodiment of the present invention.

DETAILED DESCRIPTION OF THE PREFERRED EMBODIMENT

Referring now to FIG. 1, there is illustrated a system 10 for removing BS&W from crude oil at the local production site or before the crude oil is transported to a refinery via a crude oil pipeline that is constructed in accordance with a preferred embodiment of the present invention. The system 10 is preferably mounted on a skid 12 that can be loaded on a trailer 14, making the system 10 portable or semi-portable and easily relocated if and when portability is a useful benefit. All system components are preferably pre-piped. Although not illustrated, piping is preferably extended to the edge of the skid 12 where hammer union connections allow for easy and rapid hook-up. The skid 12 can be mounted on a trailer 14 for ultimate portability, or set on a suitable foundation (not illustrated) for semi-permanent services.

The system 10 employs a chemical additive that is introduced into the raw crude oil stream from a chemical additive tank 16 via chemical additive line 18 as the raw untreated crude oil is enters the system via crude oil inlet line 20. The crude oil is pumped into the system 10 by a low shear pump 22. The chemical additive will be selected specifically for the site specific needs, but generally will be an emulsion breaking chemical or demulsifier. The pump 22 mixes the chemical additive sufficiently with the crude oil without causing the mixture to form an emulsion.

The pump 22 used in this system 10 is specially selected. Most pumps tend to aggravate the BS&W content of crude oil, thus acting as blenders. Therefore, the present invention employs a non-blending, non-shearing pump 22 known as a progressing cavity pump. This type of pump is characterized as being similar in design to an auger or meat grinder. This pump design eliminates the detrimental shearing forces by replacing sharp edges with smooth surfaces, and uses only low speeds, eliminating the blending effect of typical pumps. This pump 22 is fitted with a special motor and motor controller which allow the pump speed to be varied and thus, allowing the fluid flow through the system 10 to be varied.

The pump 22 sends the mixture through a plate and frame type heat exchanger 24 where the incoming crude oil mixture is preheated using the already heated and dehydrated outgoing stream of crude oil. A plate and frame type heat exchanger 24 is employed because of its very large heat transfer fluid contact surface area and its small, light-weight footprint, making it ideal for portability.

The preheating of the incoming crude oil mixture that occurs in the heat exchanger 24 lowers the viscosity (thickness) of the incoming crude oil mixture so the heavier water droplets contained within the mixture can more readily separate as they enter an oil-water separator 26 provided in the system 10. Such a separator is taught in U.S. Pat. No. 8,465,572 that issued on Jun. 18, 2013 for Horizontal Heater Treater. The teaching found in U.S. Pat. No. 8,465,572 is incorporated herein by reference.

Upon leaving the heat exchanger 24, the preheated crude oil mixture flows through an incoming electronic BS&W monitor 28 that continuously measures the varying levels of BS&W concentration entering with the incoming crude oil and also flows through an inlet electronic flow meter 30 that continuously measures the quantity of crude oil and its entrained BS&W entering the system 10 and flowing to the system's oil-water separator 26.

The effluent of treated, dehydrated crude coming out of the separator 26 also flows through an outgoing electronic BS&W monitor 32 and through an outgoing electronic flow meter 34 that continuously measure, respectively, the concentration of BS&W exiting the system 10 in the treated crude oil and the quantity of treated crude oil flowing out of the system 10.

The signals coming from the incoming electronic BS&W monitor 28 and the inlet electronic flow meter 30 are transmitted to a project logic controller (PLC) 36 via communication lines 38 and 40. respectively. Likewise, the signals coming from the outgoing electronic BS&W monitor 32 and the outgoing electronic flow meter 34 are transmitted to the PLC 36 via communication lines 42 and 44, respectively. The signals from the incoming electronic BS&W monitor 28 and the inlet electronic flow meter 30 are compared by the PLC 36 with a signal from the outgoing electronic BS&W monitor 32. The PLC 36 uses the comparison of these inputs to vary the speed of the pump 22 via communication line 46 and thus the flow rate through the system 10, to vary the chemical additive concentration added to the incoming crude oil by the chemical additive tank 16 via communication line 48, and to vary the degree of heat being applied by a secondary heating tube 50 located within the separation vessel 26 via communication line 52. This level of automation automatically optimizes the performance of the system 10, regardless of the quantity of BS&W contained within of the incoming crude oil.

Once the crude is pre-heated in the heat exchanger 24, the bulk of the entrained water readily separates, leaving only minor amounts of water in the smallest droplets in the crude oil stream. The demulsifier that was added to the incoming crude from the chemical additive tank 16 which is located upstream of the water-oil separator 26 is a chemical that assists in droplet growth and helps to separate these smallest water droplets from the crude oil. The additive causes the smallest water droplets to coalesce into much larger droplets which are much more prone to separate according to Stokes' Law of separation.

Upon entering the water-oil separator vessel 26, additional heat is added to the mixture to further reduce the crude oil viscosity and to further augment oil-water separation in the separator vessel 26. Heat is added by the large surface area secondary heater tube 50 that is similar to a household gas water heater. An industrial burner (not shown) is fitted inside the secondary heater tube 50 with the flame safety components assuring safe and efficient heat generation. The safety burner efficiently mixes gaseous fuel with air creating a quiet flame which "licks" the inner walls of a steel pipe known as the "firetube" or simply the secondary heater tube 50. This secondary heater tube 50 functions similar to the center tube in a natural gas household water heater. Gaseous fuel is supplied via gas line 54 to the industrial burner of the secondary heater tube 50 from gas separated from the oil in the separator vessel 26 and that source of gaseous fuel may be supplemented, as needed by an additional secondary gaseous fuel source 56. The secondary heater tube 50 heats the oil and emulsion at the entrance into the separator 26.

Inside the separator 26, freely separable water separates below the firetube 50 and exits the separator 26 only slightly heated, thereby conserving fuel. The crude oil, with its inherent BS&W, rises across the firetube 50. As the mixture is heated its viscosity is reduced dramatically until the crude oil and emulsion are as thin as the water itself. Heating crude not only lowers its viscosity, it also increases its effective density, making it even lighter compared to the water droplets contained within it, causing the water droplets to fall though the crude oil more rapidly. The heavier water then falls through the lighter oil and is separated from the oil at the bottom 58 of the separator 26.

Since water droplets nucleate around tiny particles of solids, as the water droplets fall out of the oil, they carry with them the solids component defined as "basic sediment". However, heat alone will not resolve the entirety of the BS&W component. The smallest droplets tend to stay suspended in the oil. While heavier than oil, the flowing velocity of the crude may exceed the falling velocity of the tiniest water droplets, thus keeping them suspended in the oil.

In order to remove these tiniest water droplets, the present system 10 employs a combination of chemical additives which are introduced from the chemical additive tank 16 via the chemical additive line 18 and a flow path within the separator 26 that takes the crude oil and water droplets through a special coalescing section 60 located inside the oil-water separation vessel or separator 26. The special coalescing section 60 is a series of stainless steel parallel, inclined thin corrugated plate surfaces that are oriented so falling droplets impinge on them in a flow path that is less than one vertical inch. The chemical additive previously introduced from the chemical additive tank 16 brings the smallest droplets together, increases their droplet size, and promotes more rapid Stokes' Law separation, while the coalescing section accumulates the tiniest of the water droplets as the crude and BS&W traverse their torturous pathways through this coalescing section 60 inside the separator 26. Water droplets impinge on the surface of the plates where they are now separated, and they migrate downward on the plate surfaces because of their higher density until they reach the water layer 62 where they disengage from the plates and become a part of the water layer 62 located beneath the oil layer in the bottom 58 of the separation vessel 26. This accelerates separation and promotes final dehydration of the smallest water droplets, resulting in a 99.99% dehydrated crude oil stream ready to be sent to any refinery.

The separated water then leaves the bottom 58 of the vessel 26 via water drain 64. Heated and dehydrated oil then flows out of the separator 26 via hot treated oil line 66 and back through the heat exchanger 24, preheating the incoming crude and cooling the dehydrated crude in the process. The dehydrated crude then is sent to clean oil storage via cool treated oil line 68. From storage, the dehydrated oil is finally shipped to the pipeline and ultimately to a refinery for further processing into petroleum products.

Since the term "BS&W" includes a caveat that the crude oil may have some sediment or solids, the separator 26 is designed so these heavy solids will accumulate on the bottom 58 of the separator 26. Any solids separating in the separator 26 will be drained from the separator 26 using a solid-dedicated "V" shaped solids removal system 70 that employs water from the bottom 58 of the tank 26 to discharge solids out of the bottom 58 of the separator 26 via a solids flush drain 72. The solid-dedicated "V" shaped solids removal system 10 is designed specifically for this purpose to avoid the necessity of having to physically enter the separator 26 to clean out the sediment, solids or sludge in the bottom of the tank 26.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A system for removing BS&W from crude oil at the local production or storage site comprising:

a low shear pump functionally connected via a first pipe to a heat exchanger for introducing incoming crude oil containing BS&W into the heat exchanger where the crude oil is heated to form preheated crude oil, the heat exchanger functionally connected to an oil-water separator via a second pipe for transferring the preheated crude oil from the heat exchanger to the oil-water separator where the preheated crude oil is further heated and where BS&W is separated and removed from the crude oil to form heated dehydrated crude oil, the oil-water separator functionally connected to the heat exchanger via a third pipe for transferring the heated dehydrated crude oil to the heat exchanger where the heated dehydrated crude oil is cooled before being stored, and a firetube provided internally in the oil-water separator that further heats preheated incoming crude oil.

2. A system according to claim 1 further comprising:

a chemical additive tank functionally connected to the low shear pump to add emulsion breaking chemicals to the incoming crude oil before the incoming crude oil enters the oil-water separator.

3. A system according to claim 2 further comprising:

an incoming BS&W monitor functionally connected to the second pipe for measuring the amount of BS&W in the incoming crude oil, and an incoming flow meter functionally connected to the second pipe for measuring the flow of incoming crude oil.

4. A system according to claim 3 further comprising:

an outgoing BS&W monitor functionally connected to the third pipe for measuring the amount of BS&W in the incoming crude oil, and an outgoing flow meter functionally connected to the third pipe for measuring the flow of incoming crude oil.

5. A system according to claim 4 further comprising:

a project logic controller functionally connected to the BS&W monitors and flow meters, said project logic controller also functionally connected to the low shear pump, to the chemical additive tank and to the oil-water separator, said project logic controller capable of using comparing measurements received from the monitors and meters to control the operation of the low shear pump, the chemical additive tank and the oil-water separator.

6. A system according to claim 1 wherein the heat exchanger is a plate and frame type heat exchanger.

7. A system according to claim 1 further comprising:

said firetube functionally connected to a gas line running from the oil-water separator which supplies gaseous fuel to a burner located within the firetube.

8. A system according to claim 7 further comprising a secondary gaseous fuel source functionally connected to said firetube for supplying supplemental gaseous fuel to the burner located within the firetube.

9. A system according to claim 8 further comprising:

a coalescing section provided internally in the oil-water separator downstream of the firetube that coalesces water droplets and assists in removing them from the crude oil.

10. A system according to claim 9 further comprising:

a solids removal system provided in a bottom of the oil-water separator for removing solids from the bottom of the tank.

11. A system according to claim 1 further comprising:

a transportable skid on which are mounted the low shear pump, the heat exchanger, and the oil-water separator.

12. A system according to claim 11 further comprising:

a movable trailer on which the transportable skid is mounted.

* * * * *